US010180028B2

(12) United States Patent
Schut

(10) Patent No.: US 10,180,028 B2
(45) Date of Patent: Jan. 15, 2019

(54) SECURITY GRILLE AND SECURITY GRILLE SYSTEM

(71) Applicant: Stackdoor B.V., Harderwijk (NL)

(72) Inventor: Tammo Schut, Harderwijk (NL)

(73) Assignee: Stackdoor B.V., Harderwijk (NL)

( * ) Notice: Subject to any disclaimer, the term of this patent is extended or adjusted under 35 U.S.C. 154(b) by 0 days.

(21) Appl. No.: 15/115,494

(22) PCT Filed: Jan. 30, 2015

(86) PCT No.: PCT/NL2015/050055
§ 371 (c)(1),
(2) Date: Jul. 29, 2016

(87) PCT Pub. No.: WO2015/115893
PCT Pub. Date: Aug. 6, 2015

(65) Prior Publication Data

US 2016/0362931 A1 Dec. 15, 2016

(30) Foreign Application Priority Data

Jan. 31, 2014 (NL) ..... 1040647
Apr. 15, 2014 (NL) ..... 2012620

(51) Int. Cl.
*E06B 9/06* (2006.01)
*E06B 9/18* (2006.01)

(52) U.S. Cl.
CPC ..... *E06B 9/0676* (2013.01); *E06B 9/063* (2013.01); *E06B 9/0623* (2013.01); *E06B 9/0653* (2013.01); *E06B 9/18* (2013.01)

(58) Field of Classification Search
CPC ..... E06B 9/0623; E06B 9/0676; E06B 9/18; E06B 9/063; E06B 9/0653
(Continued)

(56) References Cited

U.S. PATENT DOCUMENTS 1,612,771 A * 12/1926 Pfeiffer ..... E06B 9/063 160/222
3,280,888 A * 10/1966 Davis ..... E05D 15/262 160/189

(Continued)

FOREIGN PATENT DOCUMENTS

EP 1 036 911 9/2000
NL 21495 4/1930

(Continued)

OTHER PUBLICATIONS

International Search Report for PCT/NL2015/050055 dated Jun. 3, 2015.

(Continued)

*Primary Examiner* — Katherine W Mitchell
*Assistant Examiner* — Abe Massad
(74) *Attorney, Agent, or Firm* — Pillsbury Winthrop Shaw Pittman, LLP

(57) ABSTRACT

The invention relates to a security grille system (1) for securing a passage at least partly. The security grille (2) is arranged to be brought from an extended state, in which the grille (2) can block the passage at least partly, into a retracted state, in which at least a part of the previously blocked part of the passage is unblocked. The security grille (2) comprises a multiplicity of bars (4), preferably substantially horizontally extending bars (4), connected by means of multiple elongated connecting elements for interconnecting respective bars (4). The security grille system (1) further comprises a chain connected to the grille (2), preferably a chain being flexible in only one dimension and/or being roller chain, and at least one chain limiting (28) member for at least locally limiting movement of the chain (19), e.g. in a direction in which it is flexible, such as to counteract that one or more links of the chain can be substantially moved away from a regular route along which the links move when (Continued)

the grille (2) is moved from its extended state to its retracted state or vice versa.

2 Claims, 8 Drawing Sheets

(58) Field of Classification Search
USPC ..... 160/202
See application file for complete search history.

(56) References Cited

U.S. PATENT DOCUMENTS 3,850,465 A * 11/1974 Hill ..... E06B 9/165 160/133
4,035,008 A * 7/1977 Hardt ..... E06B 9/165 160/220
4,139,042 A * 2/1979 Watanabe ..... E06B 9/0638 160/36
4,493,356 A * 1/1985 Hermann ..... E06B 9/165 160/133
4,573,512 A * 3/1986 Lichy ..... E06B 9/86 160/133
4,595,043 A * 6/1986 Nozawa ..... E06B 39/0676 160/32
4,838,331 A * 6/1989 Kasai ..... E06B 9/0676 160/36
4,984,387 A * 1/1991 Wheatland ..... E05F 15/67 160/188
5,957,181 A * 9/1999 Cohen-Ravid ..... E06B 9/063 160/188
6,035,917 A * 3/2000 Cohen-Ravid ..... E06B 9/063 160/207
6,640,871 B2 * 11/2003 Cohen-Ravid ..... E06B 9/18 160/188
6,651,724 B1 * 11/2003 Cittadini ..... E06B 9/0638 160/207
6,742,563 B2 * 6/2004 Belanger ..... E06B 9/18 160/133
7,152,655 B2 * 12/2006 Clauss ..... E06B 9/26 160/133
2002/0036068 A1 3/2002 Cohen-Ravid et al.

FOREIGN PATENT DOCUMENTS

WO 98/42942 A1 10/1998
WO 01/69029 A1 9/2001
WO 2017/126968 A1 7/2017

OTHER PUBLICATIONS

Dutch Search Report dated Aug. 4, 2014 for Appln. No. 1040647.
Computer Translation of AU 107448 dated Oct. 10, 1927; publication corresponding to to NL21495.
Office Action issued in corresponding EP Application No. 15 711 590.8 dated May 3, 2018.

* cited by examiner

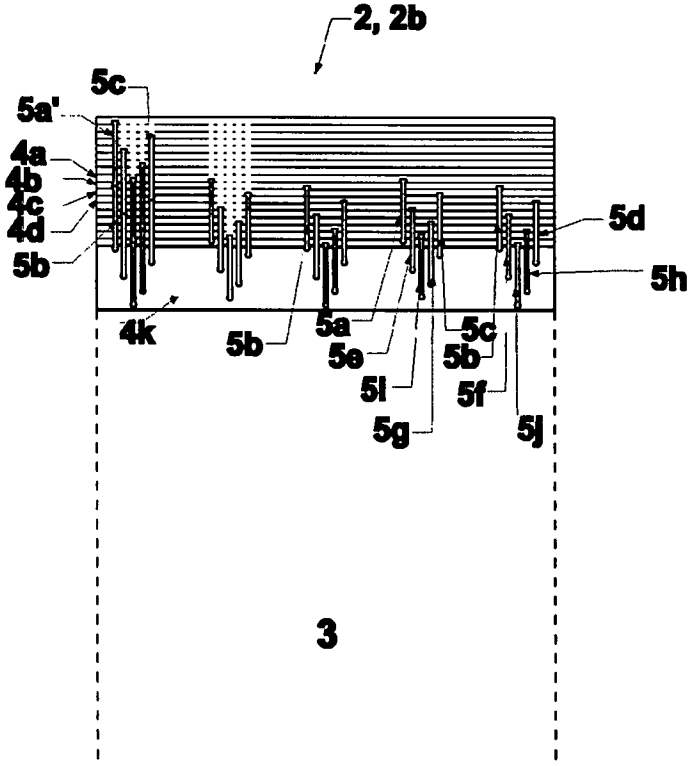
Flg.2b
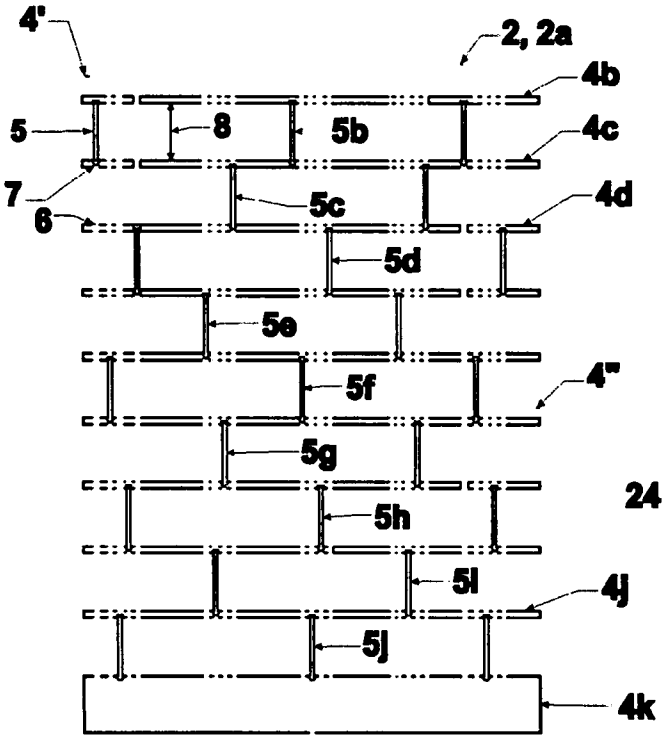
Flg. 2a

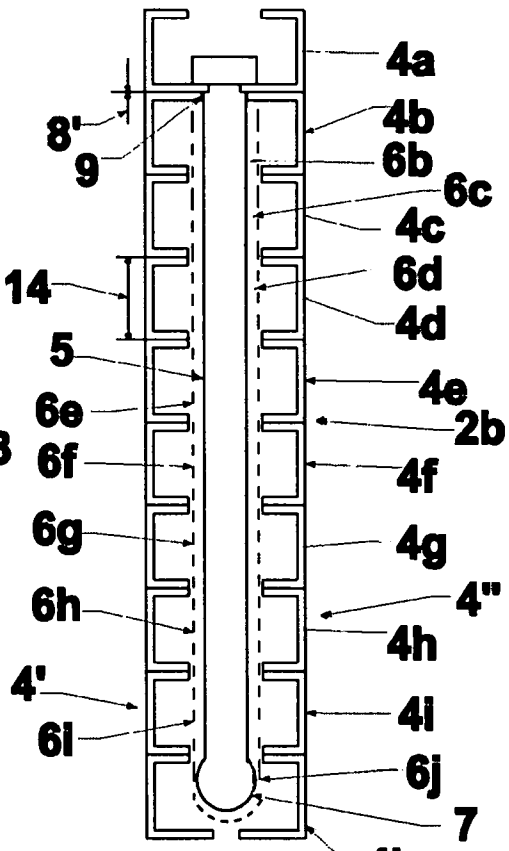
Flg. 3b
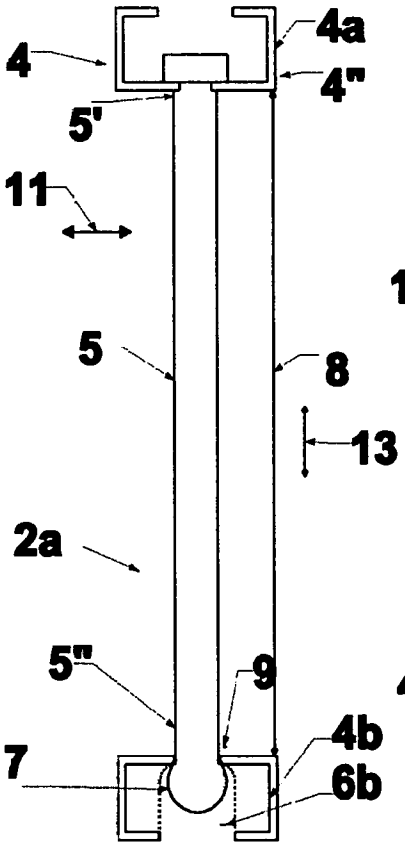
Flg. 3a

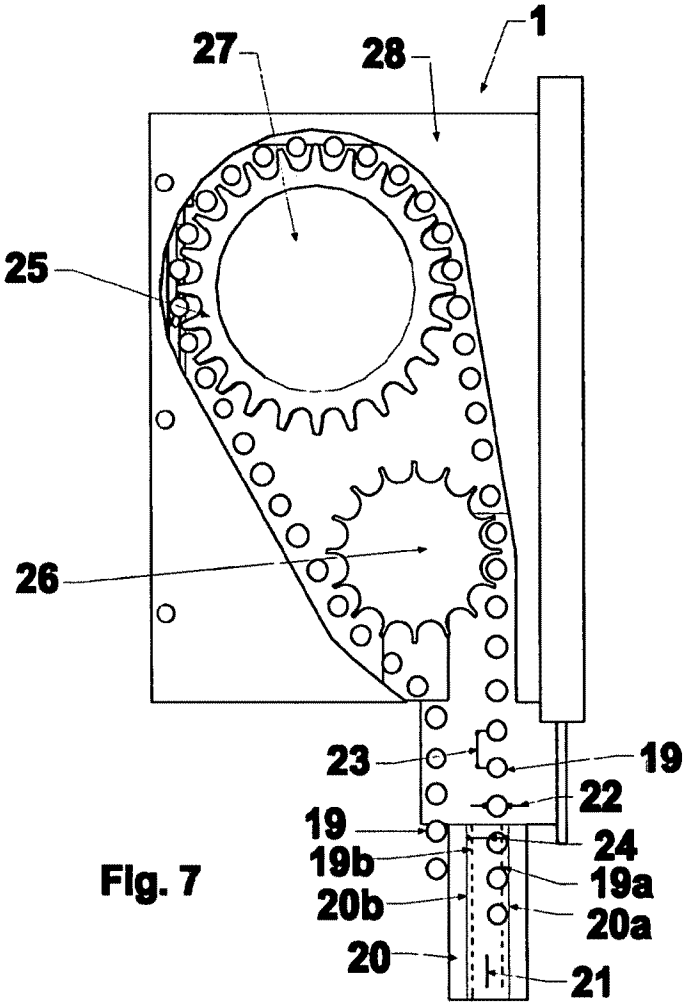
Flg. 7

SECURITY GRILLE AND SECURITY GRILLE SYSTEM

CROSS-REFERENCE TO RELATED APPLICATIONS

This is the U.S. National Stage of PCT/NL2015/050055, filed Jan. 30, 2015, which in turn claims priority to Netherlands Application Nos. 1040647, filed Jan. 31, 2014, and U.S. Pat. No. 2,012,620, filed Apr. 15, 2014, the entire contents of all applications are incorporated herein by reference in their entireties.

The invention relates to a security grille system comprising a security grille for securing a passage such as a doorway or window at least partly.

It is well known to use security grille systems to protect for instance shops, business establishments, warehouses, kitchens, schools, parking garages, etc. and/or for partitioning spaces, for instance in a shopping center or airport terminal building.

Normally, a security grille system comprises a rolling grille. Generally, such known grille comprises multiple horizontal bars pivotable connected to each other by means of pivotable pegs, each connecting two respective bars. Said pegs extend vertically in an extended state of the grille, in which the grille can block a passage, such as a doorway or window, at least partly. The grille system also comprises two upright guiding profiles for vertically guiding the ends of the horizontal bars when the grille is rolled-up and/or unrolled. Further, said known grille system comprises a rolling shaft provided at an upper part of the system. The rolling grille can be rolled up around said rolling shaft in order to retract the grille and unblock the passage. Typically, a rolled up rolling grille can have a diameter of about 40 cm or even larger. A disadvantage of the known grille system may lie in that the rolled-up grille and/or a housing for accommodating the rolled-up grille may occupy relatively much space, e.g. at or near a ceiling. Often, there may even be not enough space available in existing buildings in order to install a rolling grille system at the desired location.

Moreover, when installing two rolling grille systems in a manner that their grilles can secure two intersecting vertical planes extending substantially transverse to each other, for example at the corner of a shop floor, the rolling shafts, the rolled-up grilles and/or the grille housings of said two rolling grille systems may preclude that both grille systems can be placed with their rolling shafts and/or grille housings at the inside facing sides of said two intersecting vertical planes to be secured. For instance therefore, security grille systems are often installed with their rolling shaft and/or grille housing facing extending outward from a shop, garage or the like. This may not only be considered as unaesthetic, but may also increase the likelihood of tampering and/or burglary.

A further problem of known rolling grilles is that the unrolled grille blocking the passage may—in its extended state—be lifted partly by hand by a villain due to the presence of plenty of empty space in the grille housing when the grille is unrolled from the rolling shaft. In some known security grilles systems, this problem may be counteracted by providing a lock in order to lock a lower part, e.g. the lower bar, of the grille in its bottom position. However, when for instance a clerk starts a motor for rolling up the grille without previously unlocking the lock locking grille, the grille system will typically jam. Hence, a service man may be needed in order to fix the jammed grille, which is highly undesirable, because it may take a lot of time and/or may cost a lot of money.

A further disadvantage of known rolling grille systems can be that the width of the grilles is relatively limited, because a relatively large rolling grille requires a relatively large—and thus relatively heavy—rolling shaft and/or a relatively heavy motor for driving the rolling shaft. Typically, a rolling shaft of about 6-7 meters will have a weight of about 150-200 kg. During installation (or maintenance) such shafts often need to be handled and/or lifted by hand due to the limited space available at the location. This may lead to dangerous situation and/or physical problems, such as back injuries, and/or may be in violation of labor regulations. Therefore, the heavy weight of the rolling shaft and/or motor itself can form a disadvantage of the known grille system.

Besides, a relatively wide rolling grille requiring a relatively long rolling shaft may lead to sagging of said shaft.

An object of the present disclosure is to provide an alternative security grille system. It is an object of the present invention to alleviate or solve at least one disadvantage of one or more known security grille systems. In particular, it can be considered an object of the invention to alleviate or solve at least one of the disadvantages mentioned above. More in particular, the invention may aim to provide a security grille system which requires less space than a known rolling grille system, for instance by limiting the storage space needed to store a retracted security grille. In embodiments, the invention aims at providing a relatively wide security grille without using a relatively heavy rolling shaft and/or while counteracting sagging of the corresponding rolling shaft. Further, in embodiments, the invention may aim at counteracting that a villain can lift a security grille to such extent that one may enter through the passage to be blocked.

In a first aspect, the present disclosure provides for a security grille system, comprising a security grille for securing a passage at least partly, wherein the security grille is arranged to be brought from an extended state, in which the grille can block the passage at least partly, into a retracted state, in which at least a part of the previously blocked part of the passage is unblocked, wherein the security grille comprises a multiplicity of bars, wherein the security grille system is arranged such that the bars can be substantially stacked in the retracted state of the grille and can be substantially spaced apart with respect to each other in the extended state; and a multiplicity of elongated connecting elements, each being arranged for interconnecting two respective spaced apart bars in the extended state of the security grille in such a manner that the respective connecting element counteracts that a first one and a second one of said two spaced apart bars can be moved apart substantially further with respect to each other, wherein at least a third one of the bars, which third bar is provided adjacent the second bar, is provided with a hole arranged for receiving a part of the respective connecting element, which interconnects the first and second bars in the extended state, in the retracted state in which the second and third bars are stacked next to each other.

By providing the third bar with a hole for—in the retracted state of the grille—receiving a part of the connecting element that interconnects the first and second bars in the extended state, it can be counteracted that the connecting element prevents that the third bar can be moved toward the second bar. Hence, the third bar may be moved toward the second bar in order to stack said bars in the retracted state of the grille. As a result, the present disclosure provides a security grille that can be stacked in a relatively elegant manner.

Moreover, since the security grille can be stacked in an elegant manner in a retracted state of the grille, said grille can be stored in a relatively compact manner. Actually, the volume taken up by the stored security grille may be reduced by up to 90% or even more, compared to a conventional rolling grille for securing a similar passage, e.g. a conventional rolling grille having the same number of bars, which have the same lengths, depths and heights.

Since the present security grille system does not need space for storing a rolled-up grille and/or space for accommodating a grille housing, the system may be installed at locations having limited space. Besides, the absence of a housing for storing a rolled-up grille can enable improved aesthetics.

In embodiments, the second bar can comprise a hole through which the first connecting element extends. The grille system may then be arranged such that the second bar can be moved along the first connecting element with respect to the first bar. Said hole in the second bar may be spaced substantially in line with the hole in the third bar in the direction in which the first elongated connecting element extends.

By providing at least a first one of the elongated connecting elements, and preferably each connecting element, with a retainer element, e.g. a thickening or a lateral protruding portion, for limiting the distance over which two respective bars can be spaced apart in the extended state of the security grille, it can be counteracted in a relatively elegant manner that the respective bars can be spaced apart too far from each other.

In embodiments, the security grille can be arranged such that the retainer element is prevented from passing through the hole in the second bar. For example, the retainer element may be wider and/or deeper than the hole in the second bar, such that the retainer element can catch the second bar when it moves away from the first bar along the connecting element, when the grille moves from its retracted state to its extended state.

Further, the security grille may be arranged such that the retainer element can move into and/or pass through the corresponding hole provided in the third bar. This is, the hole in the third bar may be wider and deeper than the retainer element. For example, the hole in the third bar may be wider and/or deeper than the hole in the second bar. As a result, at one hand, the retainer element can catch the second bar when it moves away from the first bar, while at the other hand, it may be prevented that the retainer element hinders the third bar when moving toward and/or away from the second bar.

Advantageously, at least a fourth one of the bars, which fourth bar is provided adjacent the third bar, can be provided with a hole arranged for receiving a part of the respective connecting element, which interconnects the first and second bars in the extended state, in the retracted state. In embodiments, the first connecting element can extend through holes in multiple succeeding bars in the extended state of the grille. For example, the connecting element can extend through holes in between two and fifteen bars succeeding the second bar. Hence, the connecting element may be relatively long with respect to the height of the bars. As a result, the connecting element can extend through a relatively large number of stacked bars in the retracted state, while the first and second bar may be spaced away from each other relatively far in the extended state of the grille.

Advantageously, the security grille may further comprise at least one bar guide, e.g. formed by a guiding profile and/or formed in a side pillar of a frame of the system, for guiding the bars when moving from the retracted state toward the extended state or vice versa and/or for counteracting that the bars, or at least respective parts thereof, can be moved in a transverse direction substantially transverse to the direction in which the bars extend and substantially transverse to the direction in which the bars are substantially spaced apart in the extended state. Preferably, the system can comprise at least two bar guides, e.g. guiding profiles, wherein each one may be provided to extend at a lateral side of the grille in its extended state. In embodiments, the guiding profiles may form a part of relatively rigid frame mountable at the passage to be blocked by the grille.

Since the bars of the grille can be stacked or piled up, and do not need to be rolled up, there is no need for a rolling shaft around which the grille can be rolled up. Since a relatively heavy rolling shaft can be omitted, the installation work can be relatively light. It is noted that for instance a lifting member such as a chain may be installed, for example engaging a driven sprocket wheel. Then, the chain, e.g. an end portion thereof, may be connected to grille which for instance can be substantially formed as assembly of bars and connecting elements, preferably connected to a lower part of said grille, while said grille may for instance be located at the ground, preferably in a manner in which its bars already engage guiding elements of the system. Subsequently, the grille may be lifted, until the upper part, e.g. the upper bar, reaches is desired position. Then, the upper part of the grille can be secured, e.g. fixedly connected, in said position, e.g. by mounting it to a ceiling and/or to a frame part of the security grille system. Hence, the system itself may lift the grille during installation, whereas conventional rolling grilles often need to be lifted by hand, because there is often not enough space available for using hoisting tools when installing rolling grilles.

Another advantage of the present grille and grille system may be that stacking the bars may need less energy. Further, a relatively small electric motor can be used. Hence, installation can be relatively light, the motor can be relatively cheap and/or relatively small, which latter may benefit the aesthetics of the design of the system.

Due to omitting a rolling shaft for rolling up the grille, the width of the grille is not limited or less limited in comparison with a security rolling grille. Hence, a passage of for instance over about 8 or 10 meters, e.g. about 20, 30 or even about 50 meters may be secured by a single without the need of intermediate pillars or guiding elements.

Moreover, since the top part, e.g. a top bar, of the grille can be fixated at multiple spots, i.e. not only at end parts such as is the case with a rolling shaft, sagging of the top part and/or the grille can be counteracted relatively easily.

In contrast to a rolling grille system of which the bars need to be substantially straight in order to enable that the grille is rollable around a rolling shaft, the bars of the present grille system do not need to be straight. For example, seen in the direction in which the bars move toward each other when being stacked, the bars of the present system may be bend an/or angulated, and can for instance be substantially C-shaped or L-shaped, e.g. in order to be utilized for screening of a corner area of a shop floor in a relatively elegant manner, e.g. without pillars in the outer corner of said corner area.

Further, the present disclosure also relates to a security grille for use in embodiments of the security grille system described above.

The present disclosure also provides for a security grille system for securing a passage at least partly, wherein the security grille is arranged to be brought from an extended state, in which the grille can block the passage at least partly, into a retracted state, in which at least a part of the previously blocked part of the passage is unblocked, wherein the security grille comprises a multiplicity of bars, preferably substantially horizontally extending bars, connected by means of multiple elongated connecting elements for interconnecting respective bars, e.g. connecting elements that can be retracted into holes provided in bars or connecting elements that can be pivotable connected to respective bars in order to form a rolling grille, wherein the security grille system further comprises a chain connected to the grille, preferably a chain being flexible in only one dimension and/or being roller chain, and at least one chain limiting member for at least locally limiting movement of the chain, e.g. in a direction in which it is flexible, such as to counteract that one or more links of the chain can be substantially moved away from a regular route along which the links move when the grille is moved from its extended state to its retracted state or vice versa. Advantageously, the chain, especially a distal end of the chain, can be connected to a bar, e.g. a distal bar, especially a lower bar, of the grille and/or to a distal or lower end portion of the grille. For example, a lateral side of a link of the chain can be connected to a distal end face of a bar, e.g. the lower bar or a bottom beam, of the grille. Additionally or alternatively, the grille system may be arranged such that the chain limiting member can limit movement of at least a part of the chain along at least a part of a guided route along which the bars move when the grille is brought from its extended state into its retracted state. For example, the chain limiting member may extend at least partly parallel to a plane of the passage to be blocked at least partly by the security grille. Preferably, the system may be provided with two chains connected to the grille, e.g. one at each lateral side of the grille, wherein each chain can be limited by their own chain limiting member.

By providing the chain limiting member that can at least limit movement of the chain locally such that it can be counteracted that the chain can be substantially moved away from its regular route, a grille system can be provided that counteracts that a villain can lift the grille to such extent that one may enter through the passage to be blocked by the grille. This is, when one tries to lift the grille situated in its extended state, the grille may be lifted to a minor extent thereby taking along a part of the chain connected to the grille. Due to the nature of flexible chains which comprises linked links, the chain will buckle to some extent thereby tilting or slanting the longitudinal direction of the link connected to the grille and/or the longitudinal direction of a link located above the link connected to the grille, such that the longitudinal direction of at least one of the links of the chain will no longer be substantially in line with the direction of the regular route along which the chain moves through or along the chain limiting member when being brought from its extended state into its retracted state or vice versa. As a result, the tilted or slanted link(s) can get jammed, e.g. in or along the chain limiting member. Consequently, it can be prevented that the jammed link can be moved further upward and thereby it can be prevented that the grille part directly or indirectly connected to the jammed link can substantially be lifted any further. Hence, it can be counteracted in a relatively simple and elegant manner that a villain can lift the security grille to such extent that one may enter through the passage to be secured by the grille.

In embodiments, the chain limiting member can comprise a first chain limiting surface extending at least partly parallel to a first side, e.g. a front side, of the chain and a second chain limiting surface extending at least partly parallel to a second side, e.g. a rear side, of the chain. For example, the chain limiting member can be shaped as a profile, e.g. a U-profile, comprising said first and second guiding surfaces, e.g. as legs of the U of the U-profile. Advantageously, the chain limiting member can be arranged such that it can promote or facilitate that a tilting link of a buckling chain gets stuck relatively easily and/or can promote that a tilting link is counteracted from moving along the chain limiting member. For example thereto, one or more chain limiting surfaces of the chain limiting member can be relatively rough or uneven, and/or may be provided with protrusions such as barbs, behind which tilted links can be caught.

In embodiments, the chain limiting member can be provided in, along with and/or parallel with a bar guide for guiding the bars when moving from the retracted to the extended state or vice versa.

Advantageous embodiments of the disclosure are described below and in the appended claims.

By way of non-limiting examples only, embodiments of the present disclosure will now be described with reference to the accompanying figures in which:

FIG. 1*a* shows a schematic view of an embodiment of a security grille system having a grille situated in its extended state;

FIG. 1*b* shows a schematic view of the security grille system of FIG. 1*a* having its grille in its extracted state;

FIG. 2*a* shows a schematic cross-sectional front view of a part of an embodiment of a security grille according to an aspect of the invention in its extended state;

FIG. 2*b* shows a schematic cross-sectional front view of a larger part of the grille of FIG. 2*a* in its retracted state;

FIG. 3*a* shows a schematic cross-sectional side view of a detail an embodiment of a security grille according to an aspect of the invention in its extended state;

FIG. 3*b* shows a schematic cross-sectional side view of a detail of the grille of FIG. 3*a* in its retracted state;

Figures 8A, 8B:
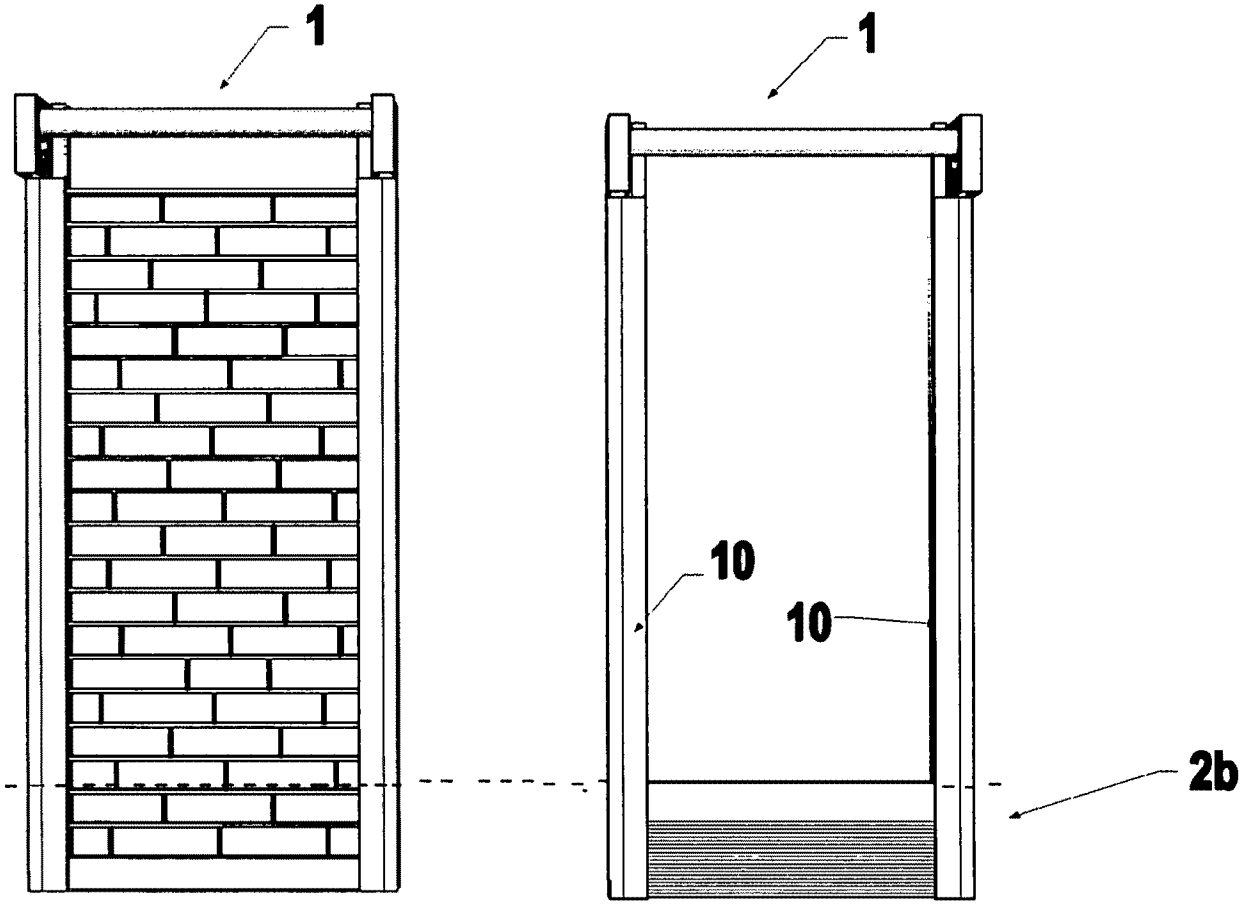

FIG. 7 a schematic cross-sectional side view of a detail of a security grille system according to an aspect of the invention;

FIG. 8*a* shows a schematic view of an alternative embodiment of a security grille system having a grille being in its extended state; and FIG. 8*b* shows a schematic view of the security grille system of FIG. 8*a* having its grille in its extracted state.

The embodiments disclosed herein are shown as examples only and should by no means be understood as limiting the scope of the invention or the disclosure in any way. In this description the same or similar elements have the same or similar reference signs.

Figure 1B:
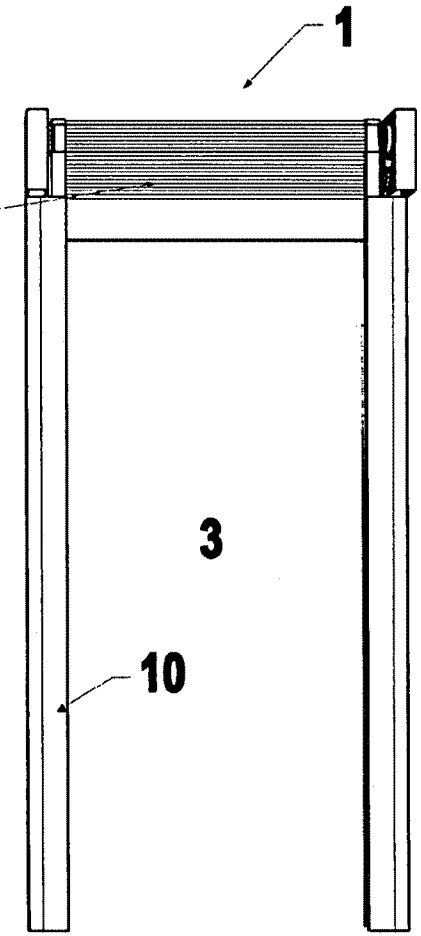
Figure 1A:
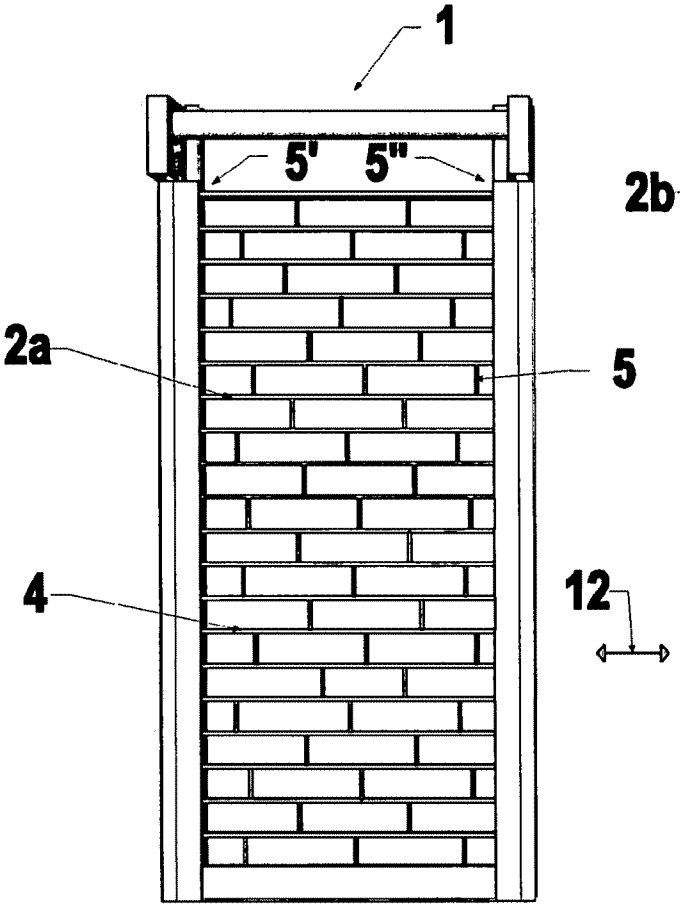
Figure 4:
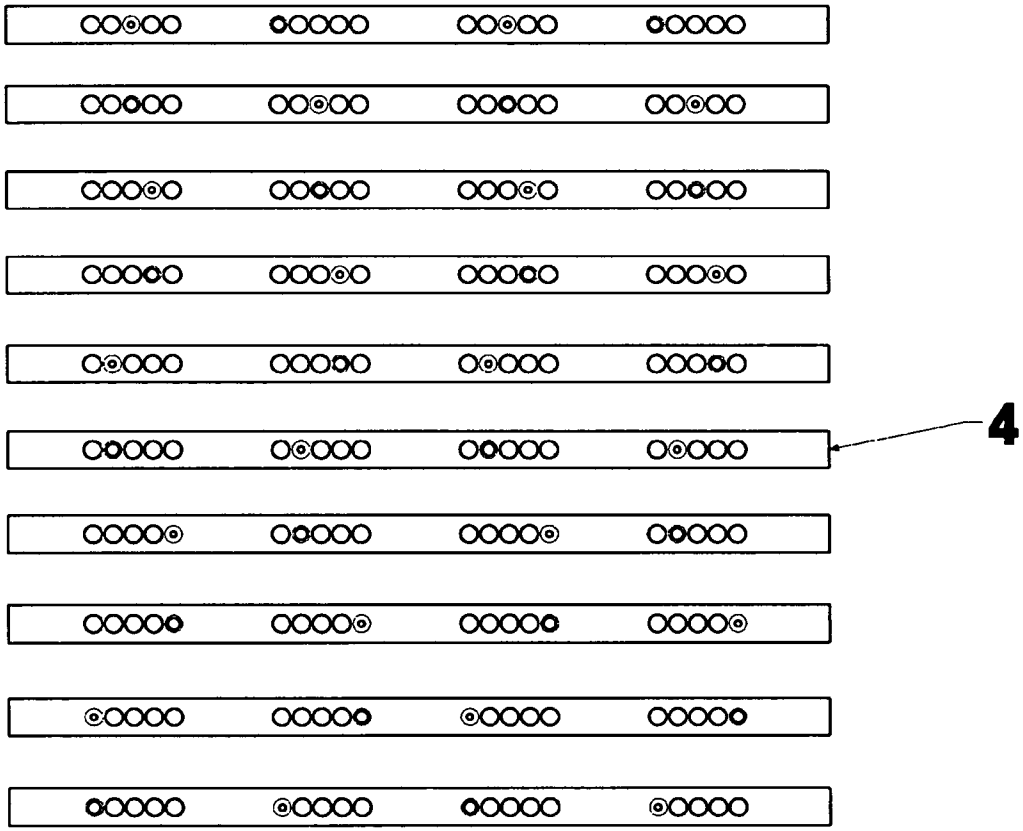
FIG. 4 shows schematic top views of successive bars of a security grille according to an aspect of the invention.

FIGS. 1*a* and 1*b* show schematic perspective views of an embodiment of a security grille system 1 comprising a security grille 2 for securing a passage 3 at least partly and/or for forming a barrier. FIGS. 2*a* and 2*b* show schematic cross-sectional front views of parts of a corresponding embodiment of a security grille 2 according to an aspect of the invention. The security grille 2 is arranged to be brought from an extended state 2*a*, in which the grille 2 can block the passage 3 at least partly, into a retracted state 2*b*, in which at least a part of the previously blocked part of the passage 3 is unblocked. For example, said passage 3 may be a doorway or window or part thereof and/or a part of a boundary of a space to be screened off by a grille at least partly.

The security grille 2 comprises a multiplicity of bars 4, especially substantially rigid bars. Advantageously, the bars can extend substantially parallel with respect to each other, e.g. being provided above each other in the vertical direction. In use, the bars 4 can preferably extend substantially horizontally, as can for instance be seen in FIGS. 1*a* and 1*b*. In order to unblock a passage 3 at least partly, in embodiments, at least a part of the bars 4 may be moved upward, as can be seen in FIGS. 1*a* and 1*b*, or downward, as can be seen in FIGS. 8*a* and 8*b* showing an alternative security grille system 1 in a retracted state 2*b*.

The security grille system 1 is arranged such that the bars 4 can be substantially stacked in the retracted state 2*b* of the grille 2 and can be substantially spaced apart with respect to each other in the extended state 2*a* of the grille. Although the bars may in the retracted state 2*b* preferably be stacked in such manner that the bars abut each other, as can be seen in FIGS. 2*b* and 3*b*, in order to limit the height of the stacked grille, at least some of the bars may alternatively be spaced apart to some extent, e.g. spaced apart over a distance 8' smaller than the distance 8 over which the bars are spaced apart in the extended state of the grille 2.

The security grille 2 also comprises a multiplicity of elongated connecting elements 5, especially substantially rigid elements 5. For example, the elongated connecting element can comprise or can be substantially shaped as a pin or peg.

Preferably, the elongated connecting elements may extend substantially parallel with respect to each other. In embodiments, the elongated connecting element may extend substantially transverse to the bars and/or extend substantially vertically.

Each elongated connecting element 5 is arranged for interconnecting two respective spaced apart bars 4 in the extended state 2*a* of the security grille 2 in such a manner that the respective connecting element 5 counteracts that a first one 4*a* and a second one 4*b* of said two spaced apart bars 4 can be moved apart substantially further with respect to each other. Advantageously, one or more connecting elements 5, e.g. each connecting element or at least a first one of said elements 5, may thereto comprise a retainer element 7 for limiting the distance 8 over which the first and second bars 4*a*, 4*b* can be spaced apart in the extended state 2*a* of the security grille 2. Advantageously, the security grille 2 can be arranged such that the retainer element 7 can be prevented from passing through a hole 6*b* in the second bar 4*b*. For example, the retainer element 7 may be or comprise a thickening or a lateral protruding portion. In the extended state of the grille 2, the retainer element 7 may cooperate with the second bar 4*b*, e.g. with a corresponding retainer element 9 comprised in said second bar 4*b*. Said corresponding retainer element 9 may for instance be formed by an edge of the hole 6*b* in the second bar 4*b* or part thereof, behind which the thickening or lateral protruding portion 7 can be caught. Preferably, the retainer element 7 can be located at or near a distal end 5" of the connecting element 5. Additionally or alternatively, the grille system 1, e.g. the hole 6*b* in the second bar 4*b*, can be arranged such that the retainer element 7 can—at least partly—be received within the second bar 4*b* in the extended state 2*a*, such as is shown in the exemplary embodiment of FIG. 3*a*, e.g. for aesthetic reasons.

Further, the connecting element 5 may in the extended state also be retained with respect to the first bar 4*a*. For example, the connecting element 5 may be retained by means of the first bar 4*a* cooperating with said connecting element 5, e.g. by means of a thickening or protruding portion of the connecting element 5 catchable by the first bar 4*a*. Alternatively or additionally, the connecting element 5, e.g. its proximal end portion 5', may be connected, especially fixedly attached, to a first bar 4*a*, for example by means of screwing, welding, gluing and/or clasping, etc.

Preferably, the grille may be arranged such that can be counteracted that the connecting element can tilt. For example, the first and/or second bar may thereto be provided with a guiding or aligning element, such as a sleeve.

As can be seen best in FIG. 3*b*, at least a third one 4*c* of the bars 4, which third bar 4*c* is provided adjacent the second bar 4*b*, preferably at a side of the second bar opposite the first bar, is provided with a hole 6*c* arranged for receiving a part of the respective connecting element 5, which interconnects the first and second bars 4*a*, 4*b* in the extended state 2*a*, in the retracted state 2*b* in which the second and third bars are stacked next to each other, e.g. above and/or on top of each other. Advantageously, the security grille 2 may be arranged such that the retainer element 7 can move into and/or can pass through the corresponding hole 6*c* provided in the third bar 4*c*. Preferably, the third bar 4*c* can comprise a hole 6*c*, e.g. a through hole, through which the first connecting element 5 extends. As a result, said third bar 4*c* may not only be arranged for receiving a part of the connecting element 5 in the retracted state, but may also be arranged to allow the connecting element 5 to extend through its hole 6*c* such that said element 5 may extend at least partly through one or more subsequent bars 4*d*-4*i* provided with corresponding holes 6*d*-6*i* as well and/or can extend until inside a further hole 6*j* provided in a further bar 4*j*. Said further hole 6*j* may for instance be arranged to receive a part of an end of the connecting element, e.g. a part of its retainer element 7, without being arranged for allowing said part to pass completely through the respective bar 4*j*. In this context, it noted that at least a fourth one of the bars, which fourth bar is provided adjacent the third bar, and preferably one or more subsequent bars 4*e*-4*j*, can be provided with a respective hole 6*d*, 6*e*-6*j* arranged for receiving a part of the respective connecting element 5 interconnecting the first and second bars 4*a*, 4*b* in the extended state 2*a*, in the retracted state 2*b*. Preferably, the hole 6*b* in the second bar 4*b* can be located substantially in line with the hole 6*c* in the third bar 4*c*, and with any further corresponding holes 6*d*-6*j*, in the direction in which the first elongated connecting element 5 extends, such that it can be facilitated that the connecting element 5 extends through said holes in the retracted state.

Although at least a third bar 4*c* is provided with a hole 6*c* for receiving a connecting element 5 at least partly, it is noted that also at least a fourth bar 4*d* may be provided with a hole 6*d* for receiving a part of a connecting element 5*b* for connecting the second bar 4*b* and third bar 4*c*. Further, one or more further bars may also be provided with respective further holes 6 for receiving parts of further connecting elements for connecting two respective bars adjacent the respective further bar.

In embodiments, the respective connecting element 5 can extend through holes 6*c*-6*j* in between two and fifteen bars 4*c*-4*j* succeeding the second bar 4*b* in the retracted state 2*b*, e.g. about five to twelve bars, such as for instance eight, nine or ten bars. Hence, the connecting element 5 may be relatively long with respect to the height 14 of a bars. For example, when a first connecting element 5 extends from the first bar 4*a* into nine subsequent bars 4*a*, 4*j*, as shown in FIG. 3*b*, said nine bars can be retracted to a stacked (as shown in FIG. 3*b*) in which the height over which said nine stacked bars extend is about ⅙ part of the height over which they are distributed in the extended state of the grille.

As can for instance be seen in FIGS. 2*a* and 2*b*, two subsequent bars 4*a*, 4*b* can be connected by means of multiple connecting elements 5*a* connecting them, which may be spaced apart in the length direction 12 of the bars. For example, two spaced apart elements connecting the same two bars, may be spaced apart over about 20 to 50 cm, e.g. about 30 cm. One or more further connecting elements 5*b*, for connecting one 4*b* of these bars with a subsequent bar 4*c*, can be located offset of the first connecting element 5, especially offset in said length direction 12 of the bar. For example, the second connecting element 5*b* can be offset relatively far from the first connecting element 5*a*, whereas the third connecting element 5*c* can—seen in the length direction 12—be located relatively close to the first element 5*a*. By locating the even numbered connecting elements 5*a*, 5*c*, 5*e*, 5*g*, 5*i* relatively close to each other and locating the odd numbered elements 5*b*, 5*d*, 5*f*, 5*h*, 5*j* relatively far away therefrom, but relatively close to each other, a substantially staggered pattern may be formed, such as shown in FIGS. 1*a*, 2*a* and 8*a*. It is apparent that when more bars are needed or desired, additional connecting elements may be provided, for instance, above said 5*a*-5*j* connecting elements, a similar pattern of additional connecting elements 5*a*', 5*c*' can be located.

As further can be seen in FIGS. 2*a* and 2*b*, the lower part 4*k* of the grille 2 may comprise a relatively high bar 4*k* or lower beam. Preferably, said lower bar or beam 4*k* and/or the holes 6 provided therein can have a height high enough to substantially accommodate the entire lower part of the connecting element 5*j* extending from the adjacent bar 4*j* located there above. Additionally, said lower bar or beam 4*k* may be arranged to substantially accommodate the portions all the higher located connecting elements 5*b*-5*j* that extend below said bar 4*j* adjacent to said lower bar 4*k*.

A relatively high lower bar or beam 4*k* may have the advantage that it is relatively heavy, thereby facilitating lowering the grille. Additionally or alternatively, an additional weight may be provided, e.g. at the lower bar 4*k*. Further, it is noted that the lower bar 5, e.g. a bottom side thereof, may be provided with one or more compressible elements, e.g. made of a rubber or rubber like material, such as a strip thereof, for absorbing a part of forces when the lower bar hits the ground.

It is noted that the bars may comprise a metal or alloy, e.g. steel and/or an aluminum alloy. For example, the bars may comprise an extrusion profile, as can be seen in FIGS. 3*a* and 3*b* showing schematic cross-sectional side views of a detail of the grille 2. Alternatively or additionally, one or more of the bars may comprise other materials. For example, a bar may comprise a substantially rigid core and/or a reinforcement element, e.g. made of metal, and a cover made of another material, e.g. comprising a plastic or wood material, for instance for aesthetic reasons.

Here, the bars 4 are shaped as substantially rectangular beams 4. However, in alternative embodiments, one or more bars may have different shapes. For instance, a bar 4 may have a round or rod-like shape. It is also noted that some bars may of different design than other bars. For example, one or more of the bars, preferably one or multiple bars located substantially at a height corresponding to a front side of car, may be reinforced in order to counteract ram-raiding, and/or may be provided with a bumper or fender.

In embodiments, the security grille system 1 may further comprise at least one bar guide 10, e.g. a guiding profile 10, which may be part of and/or attached to a frame of the grille system, e.g. a side pillar of said frame. Said bar guide and/or side pillar may for instance be made of and/or comprise a metal, e.g. steel or an aluminum alloy, and/or a plastic material. The bar guide 10, exemplary embodiments of which can be seen e.g. in FIGS. 1*a*, 1*b*, 5 and 6, may be arranged and/or intended for guiding the bars 4 when moving from the retracted state 2*b* toward the extended state 2*a* or vice versa. For example, the bar guide 10 may be provided with one or more bar guiding surfaces 10*a*, preferably extending partly along a front side 40 and or a rear side 41 of the bars 4. Additionally or alternatively, the bar guide 10 may be arranged and/or intended for counteracting that the bars 4, or at least respective parts thereof, can be moved in a transverse direction 11 substantially transverse to the direction 12 in which the bars 4 extend and substantially transverse to the direction 13 in which the bars 4 are spaced apart in the extended state. Hence, it can be counteracted that a villain pushes or pulls the extended grille 2 away in said transverse direction 11.

As can be seen in the exemplary embodiment of FIGS. 1*a* and 1*b*, a first bar guide 10 can be located at or near first end portions 4' of the bars 4. Additional, a second bar guide 10 can be located at or near second end portions 4" of the bars.

Figure 5:
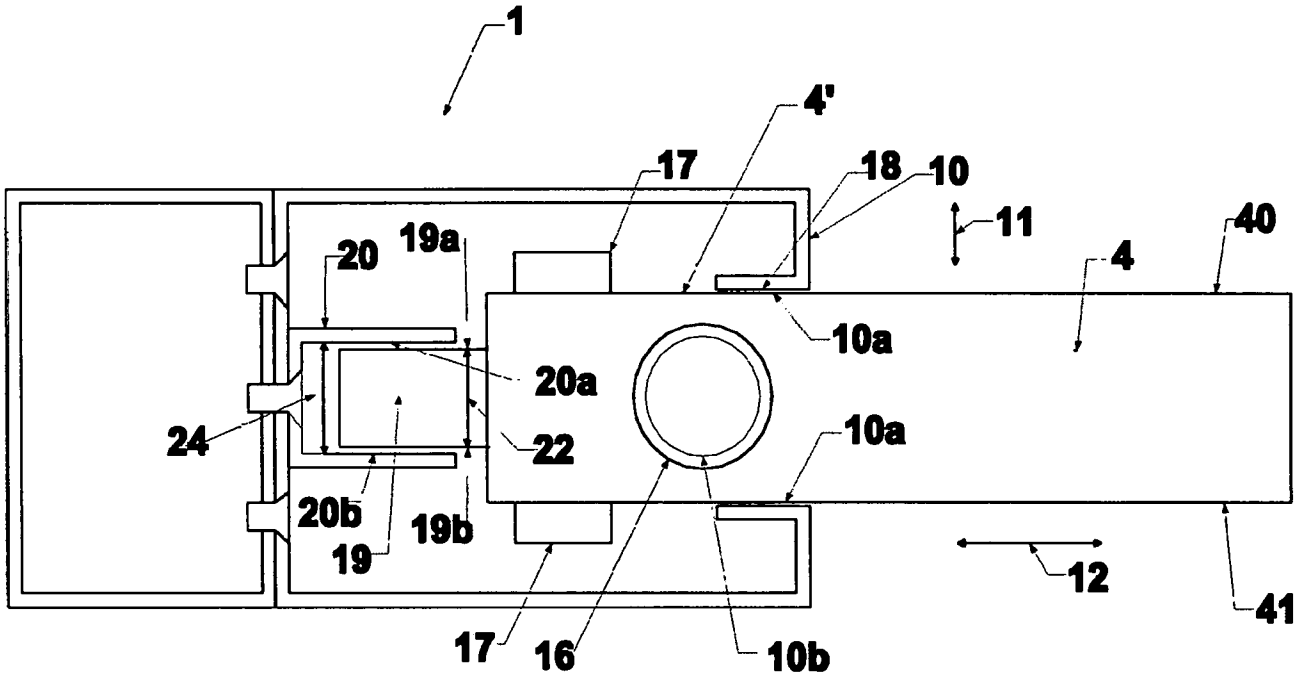
FIG. 5 shows a schematic cross-sectional top view of a detail of a security grille system according to an aspect of the invention.
Figure 6:
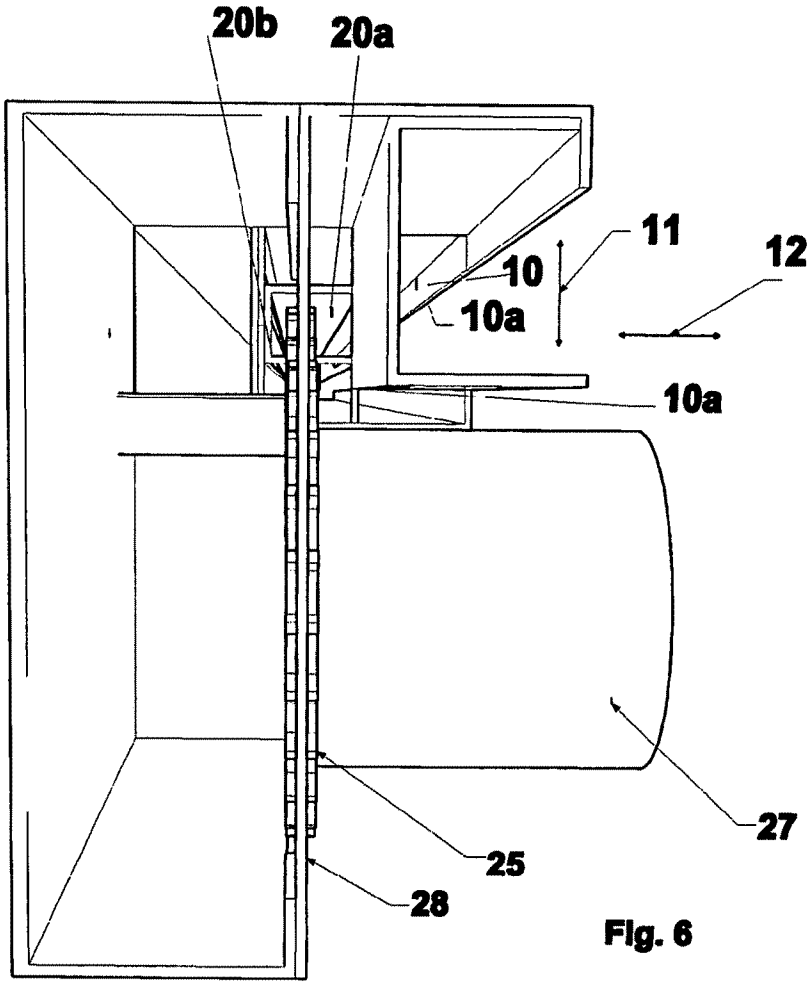
FIG. 6 shows a schematic perspective top view of a detail of a security grille system according to an aspect of the invention.

Alternatively or additionally, a bar guide 10*b*, e.g. a substantially rod shaped guide 10*b*, may be provided which extends through corresponding aligned holes 16 in the bars 4, as is shown in FIG. 5. An advantage of such bar guide 10*b* may be that can be counteracted that end portions 4', 4" of the bars 4 can be pulled or pushed out of their position, e.g. out of the guide profile 10, as a result of bars being exposed to forces tending to bend said bars and/or forces tending to pull the bars in the direction in which said bars 4 extend.

Alternatively or additionally, one or more of the bars may be provided with protruding parts 17, protruding forward or rearward, which may cooperate with bar limiting means 18 for counteracting that the end portion 4', 4" of the bar can be pulled out of its position, e.g. out of a guide profile 10.

In embodiments, the security grille system 1 can further comprise one or more moving members, e.g. a cable or chain, for moving at least a part of the bars 4. Preferably, said moving member may be a lifting member or so-called hoisting member for lifting or hoisting at least a part of the bars 4. Advantageously, the lifting member, especially its distal end portion, can be attached to a part of the grille that in the extended state is located the furthest away from the storing position of the grille.

Further, it is noted that the lifting member can be provided at or near a side edge part of the grille system 1. Advantageously, two side edge parts can be provided with lifting members, preferably cooperating lifting members. Hence, slanting of the bars can be counteracted.

In case the system 1 is for instance arranged for storing the bars 4 at or near a top portion of the grille system 1, such as in the embodiment of FIGS. 1*a* and 1*b*, the lifting member 19 may be attached to a lower part of the grille, e.g. a lower bar. Further, a top part of the grille, e.g. a top bar, may be secured at a top portion of the grille system, e.g. by means of fixing the top part or bar to an upper part of the guiding profiles and/or by fixing said top part or bar to a respective building in which the system is installed, e.g. a ceiling thereof. In the retracted state of the grille 2, the lifting member 19 may be secured such that said lower part of the grille cannot move downward. When veering out the lifting member 19, the lower part, e.g. the lower bar, may move downward, e.g. under the action of the gravitational force. For instance with exception of the secured top bar 4*a*, the bars provided above the lower part may move downward as well, until the penultimate bar 4*b* is restricted for moving further downward by means of the first connecting element 5. When further veering the lower part, the other bars can keep moving down, until a third bar 4*c* will be stopped from moving further by means of a second connecting element 5 limiting the distance between the second and third bars 4*b*, 4*c*, and so on, until the lower part, e.g. the lower bar, is in its lower position and the grille is situated in its extracted state. In order to move the grille back from the extended state toward its retracted state, the lifting member can be raised, thereby lifting the lower part, e.g. the lower bar, upward, which lower part may subsequently push the bars situated above it upward as well, e.g. until the bars located between the top bar and the lower part are stacked together and/or prevent the lower part from moving further upward.

In alternative embodiments, such as for instance in the embodiment of FIGS. 8*a* and 8*b*, the system 1 can be arranged for storing the bars 4 at or near a bottom portion of the grille system 1. Then, the lifting member 19 may be attached to a top part of the grille, e.g. a top bar. Advantageously, a lower part of the grille, e.g. its lower bar, can be secured at or near a bottom portion of the grille system. When the lifting member lifts the top bar, the top bar 4*a* can be moved away from the subsequent bar 4*b* until the first elongated connecting element 5 limits further separation and causes said subsequent bar to move upward together with the first bar. Since a similar elongated connecting element 5 can be provided for connecting the second bar 4*b* with a third bar 4*c* in the extended state, said second connecting element can cause that the second bar can in turn pull the third bar upward. A further connecting element limiting the distance between the second and a third bar can cause that the third bar is pulled upward when the distance between the second and third bar reaches it maximum. The other bars can be pulled upward similarly, until the top part of the grille, e.g. the top bar, reaches its top position and/or until all bars are maximally spaced apart with respect to their adjacent bars. In order to unblock the passage 3, the lifting member 19 may be veered in order to lower the top part of the grille, which can cause the grille to collapse.

Advantageously, the moving member, e.g. the lifting member 19, is or comprises a chain 19, which can comprise a series of interconnected links. Preferably, the chain is flexible in only one direction and/or is a roller chain 19. Preferably, the chain, e.g. a respective link thereof such as an ultimate link, can be connected to the grille, e.g. a respective bar of the grille such as the lower or top bar, especially in a substantially pivotable manner.

The chain 19 can be a roller chain. As noted, two side edge parts of the grille can both be provided with a respective lifting member, e.g. a chain. For example, each chain engages a respective driving sprocket wheel 25, as shown in the exemplary embodiment of FIG. 7 which shows a schematic cross-sectional side view of a detail of a security grille system 1. Both sprocket wheels 25 may be mounted on a shared axis 27 and/or may be driven by a single motor, preferably an electric motor, such as a tubular motor provided in said shared axis 27 which may be substantially be formed as hollow tube. However, the system 1 may alternatively or additionally be provided with another type motor an/or may comprise means for manually lifting and/or veering the grille, e.g. by means of a removable crank handle.

As can be seen in FIG. 7, the system may comprise a restraining element 28 for restraining the chain and counteracting that it can be disengaged with the respective driven sprocket wheel 25. For example, the restraining element 28 may be formed by a part of a plate having a hole, e.g. a recess or through hole, having a border corresponding with chain engaging the sprocket wheel.

Further, the security grille system 1 can comprise at least one chain limiting member 20 for at least locally limiting movement of the chain 19, e.g. in a direction in which it is flexible, such as to counteract that the chain can be substantially moved away from a regular route 21 along which it moves when the grille 2 is moved from its extended state 2*a* to its retracted state 2*b* or vice versa. For example, the chain limiting member 20 may extend at least partly parallel to the plane of the passage 3 to be blocked at least partly by the security grille. In embodiments, the chain limiting member can be provided in, along with and/or parallel with the bar guide for guiding the bars. Advantageously, the chain limiting member 20 can comprise two chain limiting surfaces 20*a* and 20*b*, e.g. defining a chain channel between them. For instance, a first chain limiting surface 20*a* can extend at least partly parallel to a first side 19*a*, e.g. a front side 19*a*, of the chain 19 and a second chain limiting surface 20*b* extending at least partly parallel to a second side 19*b*, e.g. a rear side 19*b*, of the chain. Preferably the first and second chain limiting surfaces can be spaced apart or offset from each other to such extent that the chain can move upward and downward between said surfaces when the system moves the grille from its retracted state into its extended state or vice versa, e.g. when the chain is substantially is held under tension and/or stretched, e.g. at least partly due to gravitation. On the other hand, the interspace or offset distance 24 between the first and second chain limiting surfaces 20*a*, 20*b* can be limited to such extent that can be facilitated that a tilting link can get stuck between said surfaces 20*a*, 20*b*. For example, the offset distance 24 can be larger than the depth 22 of a link, preferably at least 5% larger, more preferably at least 10%, while said offset distance 24 can be smaller than the height 23 or so-called length 23 of a link of the chain, preferably at least 10% smaller, more preferably at least 20% smaller.

It is noted that the chain limiting member 20 can be shaped as a profile, e.g. a U-profile and/or an extrusion profile, comprising said first and/or second chain limiting surfaces 20*a*, 20*b*, for example as legs of the U of the U-profile. Advantageously, the chain limiting member 20 can be arranged such that it can facilitate or promote that a tilting link of a buckling chain gets stuck and/or can facilitate or promote that a tilting link is counteracted from moving along the chain locating member. For example, one or more guide surfaces of the chain locating member can be relatively rough or uneven, and/or may be provided with protrusions such as barbs.

Preferably, the driven sprocket wheel 25 and the chain limiting member 20 can be positioned such that the part of the chain 19 connected to the grille and hanging from the sprocket wheel can move straight between the first and/or second chain limiting surfaces 20*a*, 20*b*. Alternatively, such as for instance in the embodiment shown in FIG. 7, an additional chain guide can be provided, for instance formed by a non-driven sprocket wheel 26, in order to facilitate that the chain can be move straight into and/or out of a channel between the first and/or second chain limiting surfaces 20*a*, 20*b*.

It is noted that the chain can have two ends. For example, a first end portion is attached to a lower part of the grille, and said end portion moves between the chain limiting surfaces 20*a*, 20*b* during use. Preferably, the chain is of such length that the chain keeps engaged with the driven sprocket wheel when the first end portion is at its lower position when the grille is in its extended state. A second end portion 19" of the chain which may hang downward at a rear side of the driven sprocket wheel 25 may move downward, e.g. due to gravitation, when the first end portion of the chain is pulled upward. For example, the system may comprise guiding means for guiding said portion of the chain. Moreover, the second end portion may be provided with a weight in order to tension said portion of the chain.

Although the chain limiting member 20 is here described in the context of a grille system having a collapsible guide grille 2 with stackable bars 4 and connecting elements that can be at least partly retracted in one or more of its bars, it is apparent to a person skilled in the art that the chain limiting member 20 can also be advantageously applied with alternative security grilles, such as for instance a rolling grille. In such case, an alternative security grille can for instance be provided with a chain which, especially an end part, can be connected to the grille, preferably by connecting said chain to a lower part, such as a lower bar, of the grille. It is noted that such chain does not need to be utilized for lifting up bars of the grille. For instance, such alternative grille can be lifted separated and/or alternative lifting means. For example, when the grille is a rolling grille, it may be lifted by rolling it up around a rolling shaft. Further, a teeth sprocket meshing with the chain may be provided, for instance in line with and connected to the rolling shaft in case of a rolling grille. Hence, when the rolling grille is unrolled or rolled up, the chain can be moved through and/or along the chain limiting member. Preferably, the grille system can further comprise a chain tensioning means, such as a non-driven sprocket wheel, which may be biased toward a front side 19*a* or a rear side 19*b* of the chain. The invention is not restricted in any manner to exemplary embodiments described above and/or depicted in the drawing.

For instance, all combinations of (parts of) embodiments described and/or shown are understood to fall within the inventive concept. It will be understood that many variants are possible.

Further, it is noted that although the holes in the bars are here depicted as round holes, the holes may have alternative forms and/or may be formed as recesses extending from a front or rear side of the respective bar.

As another example, the system may be provided with one or more safeguards and/or sensors, e.g. for detecting that there is something in the way of the grille or one of its bars moving up or down, such as to prevent people from being harmed and/or goods or the grille system from being damaged.

These and other embodiments will be apparent to the person skilled in the art and are considered to lie within the scope of the invention as formulated in the following claims.

The invention claimed is:

1. A security grille system comprising:

a security grille for securing a passage at least partly, wherein the security grille is arranged to be brought from an extended state, in which the grille blocks the passage at least partly, into a retracted state, in which at least a part of the previously blocked part of the passage is unblocked, wherein the security grille comprises a plurality of bars connected by multiple elongated connecting elements for interconnecting respective bars; the security grille system further comprising:

a driven sprocket wheel;

a chain connected to the security grille;

said chain engaging said driven sprocket wheel; and at least one chain limiting member comprising two interspaced chain limiting surfaces defining a chain channel therebetween, said two chain limiting surfaces being interspaced such as to allow the chain to buckle when a lower chain link is lifted towards a higher chain link and such that a tilting chain link of the buckling chain gets stuck between said two opposite chain limiting surfaces of the chain limiting member, and a non-driven sprocket wheel positioned for facilitating that the chain moves straight into or out of the chain channel, said non-driven sprocket wheel being positioned between the driven sprocket wheel and the at least one chain limiting member, the system further comprising a restraining element for restraining the chain, said restraining element being formed by a part of a plate having a recess with a border corresponding with the chain engaging the driven sprocket wheel and the non-driven sprocket wheel.

2. The security grille system according to claim 1, wherein a first end portion of the chain is attached to a lower part of the grille, and the chain is of such length that the chain keeps engaged with the driven sprocket wheel when the first end portion is at its lower position when the grille is in its extended state.

* * * * *